United States Patent [19]

Tillery

[11] Patent Number: 4,875,200

[45] Date of Patent: Oct. 17, 1989

[54] ILLUMINATING BEZEL

[75] Inventor: John T. Tillery, Alexandria, Va.

[73] Assignee: The United States of America as represented by the Secretary of the Army, Washington, D.C.

[21] Appl. No.: 265,446

[22] Filed: Nov. 1, 1988

[51] Int. Cl.[4] ..... G04B 19/30

[52] U.S. Cl. ..... 368/67; 368/227; 368/295; 362/23

[58] Field of Search ..... 368/67, 83, 223–227, 368/241, 294–297; 362/23–30

[56] References Cited

U.S. PATENT DOCUMENTS

| | | | |
|---|---|---|---|
| 3,722,206 | 3/1973 | Berget | 368/67 |
| 3,748,456 | 7/1973 | Brien | 362/23 |
| 3,754,140 | 8/1973 | Stone et al. | 368/227 |
| 4,775,964 | 10/1988 | Alessi et al. | 368/67 |

*Primary Examiner*—Vit W. Miska

*Attorney, Agent, or Firm*—Milton W. Lee; Aubrey J. Dunn; Anthony T. Lane

[57] ABSTRACT

A wafer battery has a light-emitting diode attached to its jacket, with one lead of the diode soldered to the battery jacket, and the other lead extending around the battery and overhanging its anode. The combination of diode and battery is encapsulated in a cover of elastomeric material, with a pressure-sensitive adhesive on one side. The bezel is applied to crystal of an instrument such as a meter, gauge, or the like and illuminates the gauge when a series connection is completed between the battery and light-emitting diode by pressing the cover over the battery anode to make the light-emitting diode lead contact the anode. The bezel is small with respect to the surface area of the crystal to which it is applied, in order that is not obscure the scale, dial, or face of the instrument. An alternate embodiment has one lead of the light-emitting diode soldered to the battery anode and the other lead extending over the side of the battery jacket. A push rod through the cover is used to push the other lead into contact with the battery jacket to complete the circuit.

3 Claims, 1 Drawing Sheet

ILLUMINATING BEZEL

The invention described herein may be manufactured, used, and licensed by the U.S. Government for governmental purposes without the payment of any royalties thereon.

BACKGROUND OF INVENTION

This invention is in the field of deives for illuminating the scales, dials, or faces of indicating instruments. In particular, the invention arose because of the need for compass card and needle illumination. Various means have been proposed for providing such illumination, and include U.S. Pat. No. 2,388,276, which shows a combination flashlight and compass. U.S. Pat. Nos. 2,388,476, 3,786,571, and 4,341,023 show combinations of lenses and incandescent filament light bulbs. All of these combinations require relatively large amounts of power, are relatively large (with respect to the compass size) and are fragile. U.S. Pat. No. 4,115,994 uses a light-emitting diode to illuminate the face of a watch or the like, but does not teach how it may be applied to a compass. Obviously, since a compass depends on the magnetic field of the earth for its operation, any magnetic field introduced by current-carrying wires for a light bulb or light-emitting diode might cause undesirable compass needle deflections and must be carefully routed. The standard unmounted compass presently in use by the U.S. Army avoids these problems by employing tritium excited phosphors. This compass has its own problems, such as being difficult to read because of low luminosity of such phosphors. Moreover, this problem is exacerbated with the normal decrease in radioactivity of the tritium. Finally, unusuable compasses are not repairable and are not readily disposible, but must be handled as RAD waste. The instant invention avoids all of the above problems and disadvantages, and may be retrofitted to existing compasses or applied to other indicating instruments.

SUMMARY OF THE INVENTION

The invention is a device for illuminating the scales, dials, or faces of indicating instruments or the like, and consists of an encapulated series arrangement of a wafer battery, a light-emitting diode, and a pressure switch. The device has a transparent or translucent pressure-sensitive adhesive on one side with a peelable cover to protect the adhesive until the device is applied to the crystal of the particular instrument. The device covers a surface area small with respect to the crystal area of the instrument.

DESCRIPTION OF PREFERRED EMBODIMENT

Figure 1:
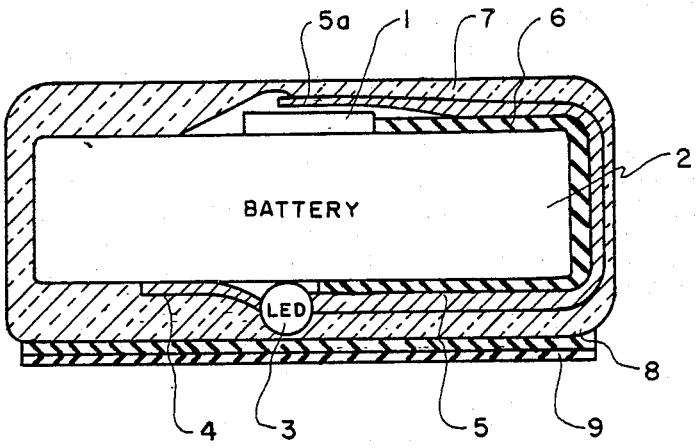
FIG. 1 is an enlarged side view, partly in section, of the preferred embodiment of the invention, not to scale.

This invention may be best understood when this description is taken in conjunction with the drawing. In the FIG. 1 embodiment, we see a wafer battery of the type now widely used in digital watches and other places. This battery has anode 1, with the jacket 2 of the battery acting as the cathode. On the bottom of the battery we see light-emitting diode (LED) 3 with leads

4 and 5. Lead 4 is soldered or otherwise connected to the battery jacket and lead 5 is brought around the battery with end 5*a* over anode 1. Insulating layer 6 prevents contact between lead 5 and jacket 2. The battery and the LED are encapulated in an elastometric material 7, which is transparent or translucent. The end 5*a* of lead 5 and anode 1 act as a pressure switch and complete a series connection between LED 3 and the battery when material 7 is pressed over anode 1. On the bottom of the battery is a transparent or translucent pressure-sensitive adhesive 8 covered by a peelable plastic or paper protective layer 9. In use, layer 9 is peeled off and the bezel is stuck on to the crystal of a particular instrument. To illuminate the instrument scale, dial, or face, one merely presses down on material 7 over 5*a*. When the battery becomes expended, the bezel is easily peeled off and replaced.

The particular battery and LED used will depend upon the particular instrument being illuminated. For a small instrument such as a watch, batteries with diameters on the order of 5 mm. are available. For larger instruments, (such as voltmeters), larger batteries, able to provide more current for larger LED's, may be used. The requirements are that the LED provide sufficient illumination for the particular instrument, and that the bezel covers an area small enough not to restrict an observer's view of the instrument face, scale, or dial.

Figure 2:
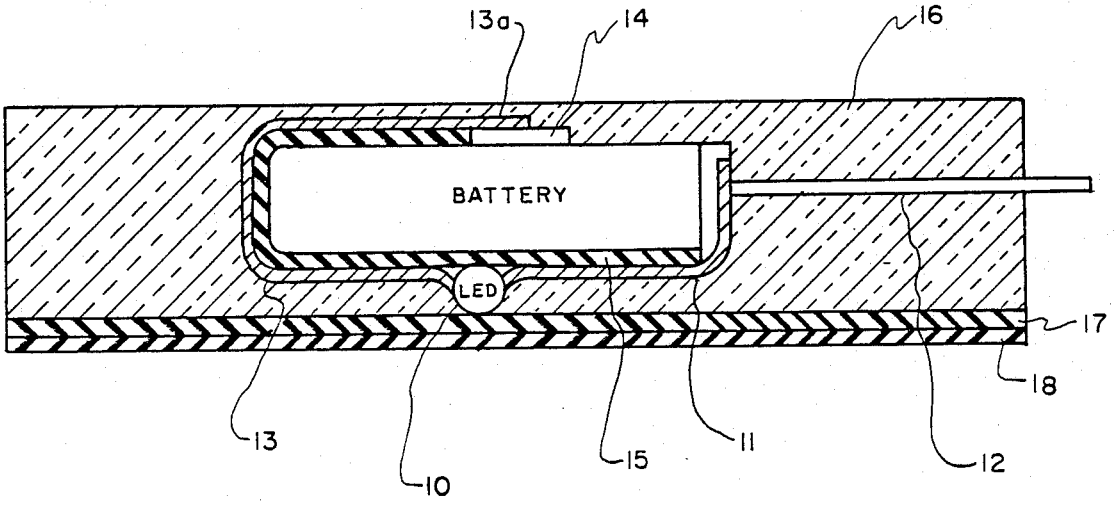
FIG. 2 is also an enlarged side view, partly in section, of an alternate embodiment of the invention, also not to scale.

The embodiment shown in FIG. 2 is usable in situations where the finger of an operator might obscure the instrument face, etc. when using the bezel. Instead of having the pressure switch on top of the battery, this embodiment has lead 11 of diode 10 carried around to the side of the battery jacket, and oprable by push-rod 12. Lead 13 of 10 is bent around the battery at end 13*a*. The leads are prevented from contacting the battery jacket by insulation 15. Transparent covering material 16 may be elastometric or may be a rigid plastic material such as plexiglas. Pressure-sensitive material 17 is applied to the bottom of the covering, and is protected by peelable layer 18. In this embodiment, covering 16 may be made as large as the crystal to which it is applied, but the battery should be small with respect to the crystal surface area.

While I have described a specific embodiment of my invention, various changes may be made within the scope of my invention. For example, instead of the LED's shown as round beads, the LED may be made in the form of a flat wafer formed or glued to the bottom of the battery. If the LED leads are covered with insulation, insulating layers 6 and 15 may be omitted. The bottom of the battery may be encapsulated separate from the remainder of the battery, in which case the remainder of the encapusation need not be transparent or translucent.

The bezel of my invention, because of the routing of the LED leads, will not affect the needle of a compast if the LED is placed over the compass needle point.

I claim:

1. A stick-on illuminating bezel for a meter, gauge or the like having a scale, dial, or face covered by a crystal, said bezel including the series connection of a wafer battery, a pressure switch, and a light-emitting diode, all encapusated in an elastomeric covering transparent on at least a portion covering said light-emitting diode, a transparent pressure-sensitive adhesive on said portion, and a peelable protective layer on said pressure-sensitive adhesive, whereby said layer is peeled from said pressure-sensitive layer in order that said device may be adhered to said crystal, and whereby said bezel has an area which is small with respect to the area of said crystal.

2. The bezel as set forth in claim 1 wherein said wafer battery has an anode and a jacket serving as a cathode and said light-emitting diode has two conductive leads, one affixed to the jacket of said battery, and the other extending over the anode thereof, to form said pressure switch.

3. The bezel as set forth in claim 1 wherein said wafer battery has an anode and a jacket serving as a cathode and said light-emitting diode has two conductive leads, one affixed to the anode of said battery and the other extending over a side portion of said battery, a push rod extending through said covering to said other conductive lead, whereby said other conductive lead and said jacket form said pressure switch.

* * * * *